US007628911B2

(12) United States Patent
Koenig et al.

(10) Patent No.: US 7,628,911 B2
(45) Date of Patent: Dec. 8, 2009

(54) RAIN GUTTER MEMBER

(76) Inventors: Thomas William Koenig, 8617 Harvest Home Dr., Mentor, OH (US) 44060; Michael Thomas Koenig, 8617 Harvest Home Dr., Mentor, OH (US) 44060

( * ) Notice: Subject to any disclaimer, the term of this patent is extended or adjusted under 35 U.S.C. 154(b) by 77 days.

(21) Appl. No.: 11/861,708

(22) Filed: Sep. 26, 2007

(65) Prior Publication Data

US 2009/0078653 A1 Mar. 26, 2009

(51) Int. Cl.
*E04D 13/076* (2006.01)

(52) U.S. Cl. ..... 210/143; 210/159; 210/162; 210/170.03; 210/459; 52/12; 134/166 R

(58) Field of Classification Search ..... 210/143, 210/159, 162, 170.03, 446, 447, 459; 52/12, 52/16; 134/166 R
See application file for complete search history.

(56) References Cited

U.S. PATENT DOCUMENTS 1,076,075 A * 10/1913 Steele ..... 210/447
1,177,174 A * 3/1916 Doty ..... 210/446
1,653,473 A * 12/1927 Schulz ..... 210/447
2,419,501 A * 4/1947 Pinto ..... 210/446
2,494,780 A * 1/1950 Schmidt ..... 210/162
2,710,616 A 6/1955 Tydings
2,887,073 A 5/1959 Thompson
4,183,368 A * 1/1980 Husted ..... 134/166 R
4,363,335 A 12/1982 Tapper
4,407,097 A 10/1983 Allen
4,745,709 A 5/1988 Johnson
4,801,377 A * 1/1989 Bolt ..... 210/162
4,837,987 A 6/1989 Fender
4,978,241 A 12/1990 Lawson
5,230,798 A * 7/1993 Rogman ..... 210/447
5,727,350 A 3/1998 Marcella
5,867,945 A 2/1999 Scafidi
5,985,158 A * 11/1999 Tiderington ..... 52/12
5,989,357 A 11/1999 Vilhauer, Jr. et al.
6,115,970 A 9/2000 Wilczynski
6,219,972 B1 * 4/2001 Zusy ..... 52/12
6,263,618 B1 7/2001 Jones
6,467,995 B2 10/2002 Bevilacqua et al.
6,493,994 B1 12/2002 Lucas
6,663,769 B2 * 12/2003 Hosoya ..... 210/143

(Continued)

FOREIGN PATENT DOCUMENTS

JP 2001-295323 * 10/2001

*Primary Examiner*—Christopher Upton
(74) *Attorney, Agent, or Firm*—Driggs, Hogg, Daugherty & Del Zoppo Co., LPA

(57) ABSTRACT

A gutter member includes an inlet operatively coupled to a gutter trough. The inlet is configured to receive matter such as water and non-water matter from the gutter trough. The gutter member further includes an outlet operatively coupled to a top of a downspout. The outlet is configured to pass water to the downspout. The gutter member further includes a reservoir configured to collect non-water matter. The reservoir is located between the inlet and the outlet and is lower than the gutter trough relative to the earth. The reservoir includes an exit port door configured to move between a first position in which a substantial amount of the non-water matter is retained in the reservoir and a second position in which the non-water matter is released from the reservoir.

20 Claims, 12 Drawing Sheets

U.S. PATENT DOCUMENTS

| | | | | |
|---|---|---|---|---|
| 6,739,800 | B2 | 5/2004 | Bevilacqua | |
| 6,926,210 | B2 * | 8/2005 | Baxter | 239/208 |
| 6,964,135 | B1 | 11/2005 | Slodov | |
| 7,188,784 | B1 | 3/2007 | Mullins et al. | |
| 2001/0030149 | A1 | 10/2001 | Naddy | |
| 2005/0051193 | A1 | 3/2005 | Duke | |
| 2006/0137258 | A1 | 6/2006 | Crossley | |
| 2006/0289036 | A1 | 12/2006 | Hilton | |
| 2007/0044387 | A1 | 3/2007 | Herrera | |
| 2007/0125005 | A1 | 6/2007 | Carson | |

* cited by examiner

RAIN GUTTER MEMBER

BACKGROUND

The following generally relates to a gutter system and, more particularly, to a rain gutter system configured to channel water landing in and/or moving into the gutter system, for example, due to rain, snow, etc., away from a building in a controlled manner. However, other gutter applications are also contemplated.

FIG. 1 shows an example of a section 100 of a prior art rain gutter system that can be used in connection with a building such as a house, an office, a garage, and the like. It is to be appreciated that the gutter system may include one or more other sections having similar and/or other components. The illustrated gutter section 100 includes six troughs, $\mathbf{102}_1$, $\mathbf{102}_2$, $\mathbf{102}_3$, $\mathbf{102}_4$, $\mathbf{102}_5$, and $\mathbf{102}_N$, collectively referred to as gutter troughs 102. Each of the gutter troughs 102 includes an open region 104 configured to receive water and two trough ends 106. Non-water matter may also be received in the open region 104. Each of the trough ends 106 is connected to a trough end 106 of a neighboring gutter trough 102, a gutter end cap 108, or a gutter elbow 110. In this example, the trough $\mathbf{102}_4$ includes a gutter trough drop outlet 112 through which water and non-water matter can exit. In a typical application, one or more of the troughs 102 and/or elbows 110 are affixed to a fascia board along the eaves of the building.

As shown, the trough drop outlet 112 is connected to a downspout 114 configured to channel water entering the downspout 114. In this example, the downspout 114 is connected to the trough drop outlet 112 via elbows 116 and channels the water away from the foundation of the building via an elbow 118. Another conventional technique includes using the downspout 114 to channel the water to a drain pipe or drain tile located near the foundation of the footer. Such water is often channeled from there to a storm sewer system, a French drain, a water basin with a sump pump, or the like in order to move the water away from the foundation. The downspout 114 may alternatively channel the water in the direction of another trough 102 of another section of the gutter system, for example, from an upper story level to a lower story level.

SUMMARY

In one aspect, a gutter member includes an inlet operatively coupled to a gutter trough. The inlet is configured to receive matter such as water and non-water matter from the gutter trough. The gutter member further includes an outlet operatively coupled to a top of a downspout. The outlet is configured to pass water to the downspout. The gutter member further includes a reservoir configured to collect non-water matter. The reservoir is located between the inlet and the outlet and is lower than the gutter trough relative the earth. The reservoir includes an exit port door configured to move between a first position in which a substantial amount of the non-water matter is retained in the reservoir and a second position in which the non-water matter is released from the reservoir.

In another aspect, a method for cleaning a gutter trough includes inhibiting water and non-water matter in a gutter trough from entering an outlet to a downspout that is operatively coupled to the gutter trough, jetting a first fluid into the gutter trough in a direction away from the outlet, jetting a second fluid into the gutter trough in a direction towards the outlet, collecting the water and non-water matter in a reservoir, and purging the water and non-water matter from the reservoir.

In another aspect, a rain gutter system includes a means for receiving water and non-water matter from a gutter trough, a means for separating the water and non-water matter, means for purging the non-water matter, and a means for passing the water to a downspout.

Still further aspects will be appreciated to those of ordinary skill in the art upon reading the following.

DESCRIPTION OF THE DRAWINGS

The drawings are only for purposes of illustrating examples and are not limiting. In the drawings, like numerals represent like elements.

DETAILED DESCRIPTION

Figure 2:
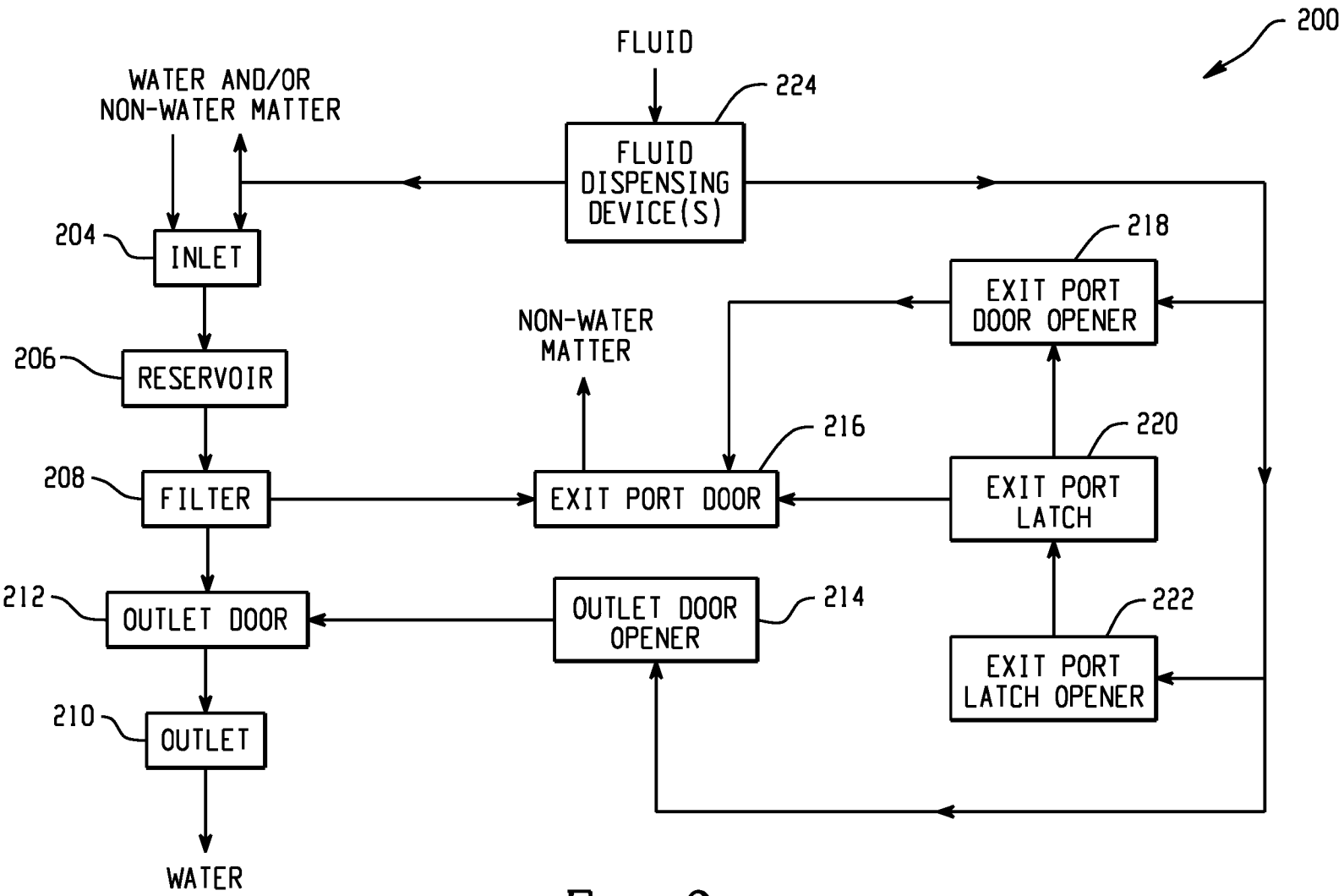
FIG. 2 illustrates a block diagram of a gutter member.

FIG. 2 illustrates a block diagram of a gutter member 200. In general, the gutter member 200 resides between and is operatively coupled to one or more gutter troughs 102 and the downspout elbow 116. The gutter member 200 is typically affixed to a fascia board or otherwise along an eave of a building such as a house, a garage, an office, etc. It is to be appreciated that the gutter member 200 may be installed with an existing gutter system on a building and a newly installed gutter system. The gutter member 200 can be made from plastic, metal, ceramic, slate, etc. for installation with plastic, metal, ceramic, slate, etc. gutter systems.

The gutter member 200 includes an inlet 204. Water and/or non-water matter such as leaves, twigs, dirt, etc. is received into the gutter member 200 through the inlet 204. Such matter may come from the gutter trough 102 and/or the roof of the building, and/or directly enter into the inlet 204. Received water and/or non-water matter is channeled to a gutter member reservoir 206 of the gutter member 200. The reservoir 206 has a finite inner volume. At least a portion of the volume of the reservoir 206 resides closer to the earth or ground relative to the gutter trough 102. Where the gutter member 200 attaches to a bottom of the gutter trough 102, the reservoir 206 lies directly beneath the gutter trough 102. Where the gutter member 200 is affixed to the gutter troughs end 106 of one or more gutter troughs 102, the reservoir 206 is offset from and lies below the gutter trough 102. The troughs 102 may be angled or sloped in a direction towards the gutter member 200.

The gutter member 200 further includes an outlet 210. The outlet 210 is configured to pass water through to the downspout elbow 116. Non-water matter may also pass through the outlet 210 to the downspout elbow 116. The gutter member 200 and/or the outlet 210 may include a lip or other mechanical structure for coupling the outlet to the downspout elbow 116.

A filter 208 or the like facilitates separating water from the non-water matter. The filter 208 can be variously shaped and located. For example, in one instance the filter 208 is generally conically shaped, with a larger end of the cone straddling the outlet 210 and the smaller end of the cone protruding into the reservoir 206. Other suitable filter shapes include, but are not limited to, an ellipsoid, a spheroid, a paraboloid, etc. In another example, the filter 208 is generally planar and is configured to lie flat over and conform to the shape of the outlet 210. In another example, the filter 208 generally extends along a substantial portion of the floor of the gutter member 200, including over the outlet 210. The filter 208 can be formed from various materials. For example, in one instance the filter 208 may include a water permeable membrane. In another instance, the filter 208 may include a wire, plastic, or other mesh. In yet another instance, the filter 208 may include a water penetrable fabric. In yet another instance, the filter 208 may include a wire screen. Other materials are also contemplated.

An outlet door 212 may be used to selectively pass water through to the downspout elbow 116. An outlet door opener 214 may be used to control the position of the outlet door 212. The outlet door opener 214 may be located within the gutter member 200, outside of the gutter member 200, or partially inside and partially outside of the gutter member 200. In one instance, the outlet door 212 transitions between a first (or closed) position and a second (or open) position. When transitioning between the first and second positions, the outlet door 212 may move about an apparatus such as pivot about a hinge, slide (advance or retract) along a track, rotate about a center line, or otherwise move. By way of non-limiting example, a hinge such as a pin hinge, a bearing hinge, a spring loaded hinge, or the like may be employed. In another implementation, the outlet door 212 is omitted.

The outlet door opener 214 may include an electrical motor, a mechanical actuator, or the like to transition the outlet door 212 between the first and second positions. Electrical wires may be run to the electrical motor to supply power to the electrical motor, for example, via conduit or another transporting line run inside or external to the downspout 114. Additionally or alternatively, one or more batteries such as one or more non-rechargeable or rechargeable batteries may be employed to supply power to the electrical motor. Additionally or alternatively, a solar cell or fuel cell may be employed to supply power to the electrical motor. For a hydraulically actuated pin such as a piston, air, water, oil, and/or other fluid may be run via a fluid transporting line inside or external to the downspout 114. As discussed in greater detail below, an environmentally safe fluid such as water can be used to actuate the piston, one or more other actuators, and facilitate flushing the gutter trough 102 and/or reservoir 206.

An exit port door 216 is configured to allow non-water matter and water to leave the reservoir 206. As with the outlet door 212, the exit port door 216 may pivot, slide, rotate, or otherwise move to transition between a first (or closed) position and a second (or open) position. An exit port door opener 218, which may include an electrical motor, a mechanical actuator, or the like, may be used to transition the exit port door 216 between the first and second positions. The exit port door opener 218 may transition the exit port door 216 based on various factors, for example, lapse of a time duration, the weight of the matter in the reservoir 206, the time of day, the day, a signal manually provided by a user, a signal provided by a program executing in a control module, etc. Additionally or alternatively, the matter in the reservoir 206 may open the exit port door 216. For example, when the force applied by the matter to the exit port door 216 exceeds a threshold force, the exit port door 216 automatically opens, and then returns to the closed position after at least some of the matter leaves the reservoir 206.

The exit port door 216 may be variously located in the gutter member 200. For example, the exit port door 216 may be on a front of the gutter member 200 opposite of a back of the gutter member 200, which is coupled to the fascia board. In another example, the exit port door 216 may be on a bottom of the gutter member 200 opposite of a top of the gutter member, which includes the inlet 104. In another example, the exit port door 216 may be on either side of the gutter member 200. In addition, the exit port door 216 may be coupled to the gutter member 200 such that the apparatus (the hinge, etc.) is located near the top, the bottom, or the side of the gutter member 200. Moreover, the exit port door 216 may encompasses an entire side of the gutter member 200, a sub-region of a side of the gutter member 200, sub-regions of multiple sides of the gutter member 200, etc.

An exit port latch 220 releasably fastens the exit port door 216. Various latches can be employed. For example, in one instance the latch 220 includes at least one magnetic component, which may be affixed to the exit port 216 and/or gutter member 200. The magnetic attraction between the magnet and a corresponding metal facilitates maintaining the exit port 216 in the closed position. In another instance, an exit port latch 220 opener 222 is used to open and close the latch. For example, in one instance the latch 220 includes a slidable bolt configured to selectively slide via a solenoid or the like in and out of a hole to lock and unlock the exit port door 216. In yet another instance, the latch 220 includes a piston configured to selectively slide via hydraulics or the like in and out of a hole to lock and unlock the exit port door 216. In yet another instance, the latch 220 includes a hook and loop type fastener that is manually engaged and disengaged. In still another instance, the latch 220 may include a rotating member that rotates in one direction to engage a latch affixed to the exit port door 216 to lock the exit port door 216 and rotates in the opposite direction to disengage the latch and unlock the exit port door 216. Various techniques can be used to selectively rotate the rotating member. Other types of latches are also contemplated.

The gutter member 200 may be variously coupled to the gutter trough 102. For instance, the gutter member 200 may be coupled to the gutter member 200 via a rivet, a screw, a nut and bolt, a weld, caulk, glue, tape, and/or the like. Additionally or alternatively, one or more intermediate structures such as a gasket, a stand off, etc. is used when coupling the gutter member 200 and the trough 102. In another instance, a releasable snap, a latch, and/or the like is used to couple the gutter member 200 and the trough 102. When coupling the gutter member 200 with a gutter trough 102, the gutter trough 102 may extend along a complementary structure of the gutter member 200. In another instance, the gutter member 200 may include one or more mechanical mounts such as a recess that receives a gutter trough end 106. In another instance, a mounting plate or seal is used to couple the gutter member 200 and a gutter trough end 106. In another instance, a gutter member 200 couples to the bottom of a gutter trough 102. Alternatively, the gutter member 200 and the trough 102 may be formed as a single unitary component.

The gutter member 200 may also be variously coupled to the downspout 114. As noted above, a lip or other structure may be configured to be received and surrounded by a perimeter of the downspout elbow 116. Such a lip may be coupled to the downspout elbow 116 (or to the downspout 114) using various techniques, including those described above with respect to the coupling between the gutter member 200 and the bottom side of the trough 102.

One or more optional fluid dispensing devices 224 dispense, jet, spray, etc. fluid into the gutter troughs 102. A suitable fluid dispensing device 224 includes a nozzle or the like, which controls the characteristics of the fluid flow. Examples of suitable nozzles include, but are not limited to, a swirl nozzle that injects the fluid tangentially, a shaping nozzle that injects the fluid as a stream, a tube nozzle that sprays the fluid, as well as other nozzles. The devices 224 are fed via a fluid line such as a water or air line, for example. Such a line may receive water from an existing water line such as a hose line or a pressurized bladder. Air may be provided via an air compressor. Other fluids may be provided otherwise.

At least one of the devices 224 may be located in the gutter member 200, facing outboard or outward towards the gutter troughs 102. Such a device 224 may be configured to control the characteristics of a fluid in a manner that facilitates filling the gutter troughs 102 with the fluid, loosening debris in the gutter troughs 102, and/or directionally moving matter, including water and/or debris, in the gutter troughs 102. Additionally or alternatively, a fluid line is run through the gutter trough 102 or otherwise run, and one or more of the devices 224 are also located near a gutter end cap 108, facing inboard or inward towards the gutter member 200. In one instance, the device 224 extends through the end cap 106. In another instance, the device 224 is disposed in the gutter trough 102, proximate the end cap 108. Similarly, the device 224 may be configured to control the characteristics of a fluid in a manner that facilitates filling the gutter troughs 102 with the fluid, loosening debris in the gutter troughs 102, and/or directionally moving matter, including water and/or debris, in the gutter troughs 102.

At least one of the devices 224 may also be used to supply a fluid to actuate the actuators used in connection with the outlet door opener 214, the exit port door opener 218, and the exit port latch opener 222, and/or supply fluid for a back wash. In these instances, the optional fluid dispensing devices 224 may include a fluid transportation line and coupling for operatively coupling the line to the actuators.

FIGS. 3-10 illustrate a non-limiting implementation of the gutter member 200. It is to be understood that these figures and the corresponding description are provided for explanatory purposes and are not exclusive.

Figure 3:
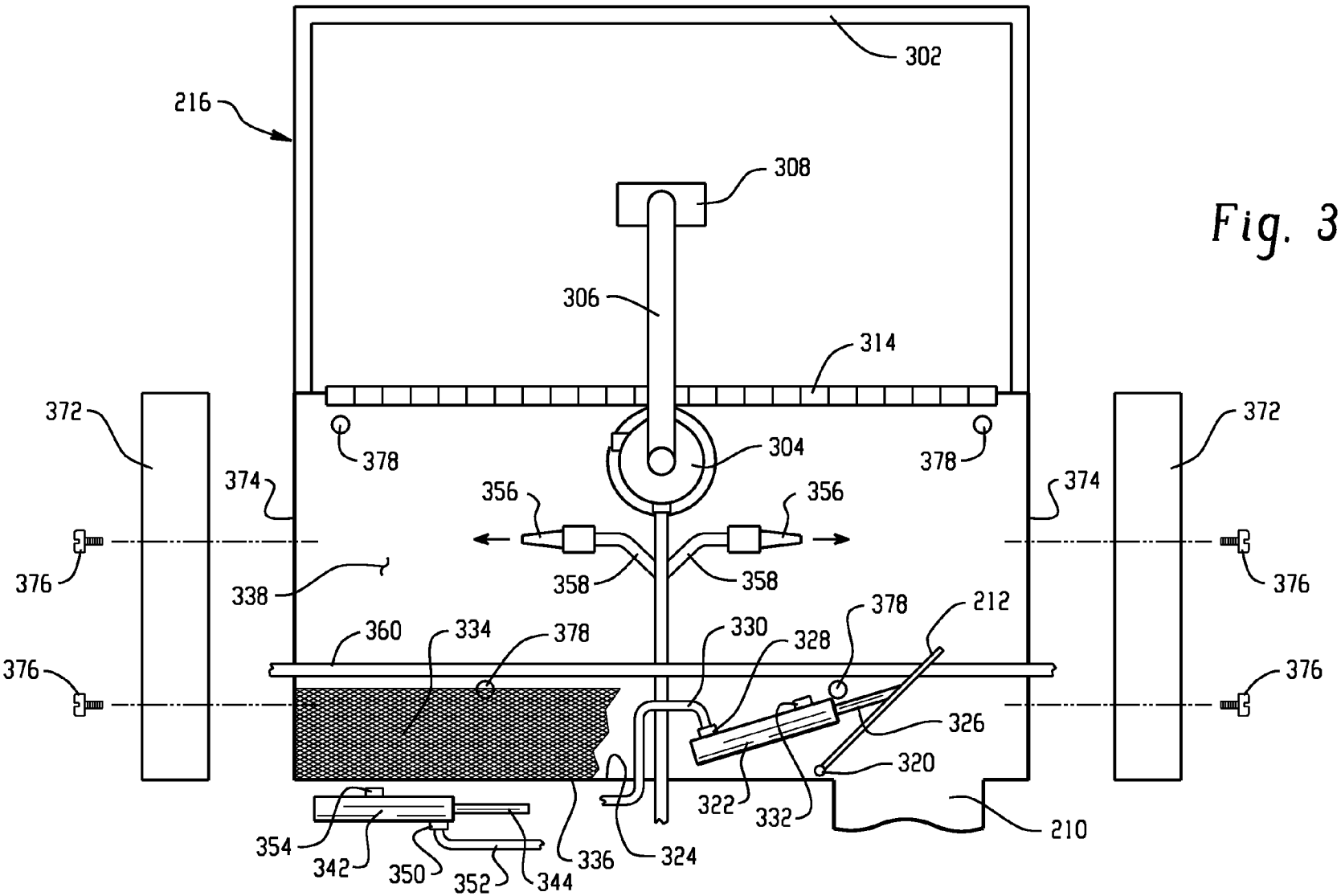
FIGS. 3-10 illustrate a non-limiting example of the gutter member.
Figure 4:
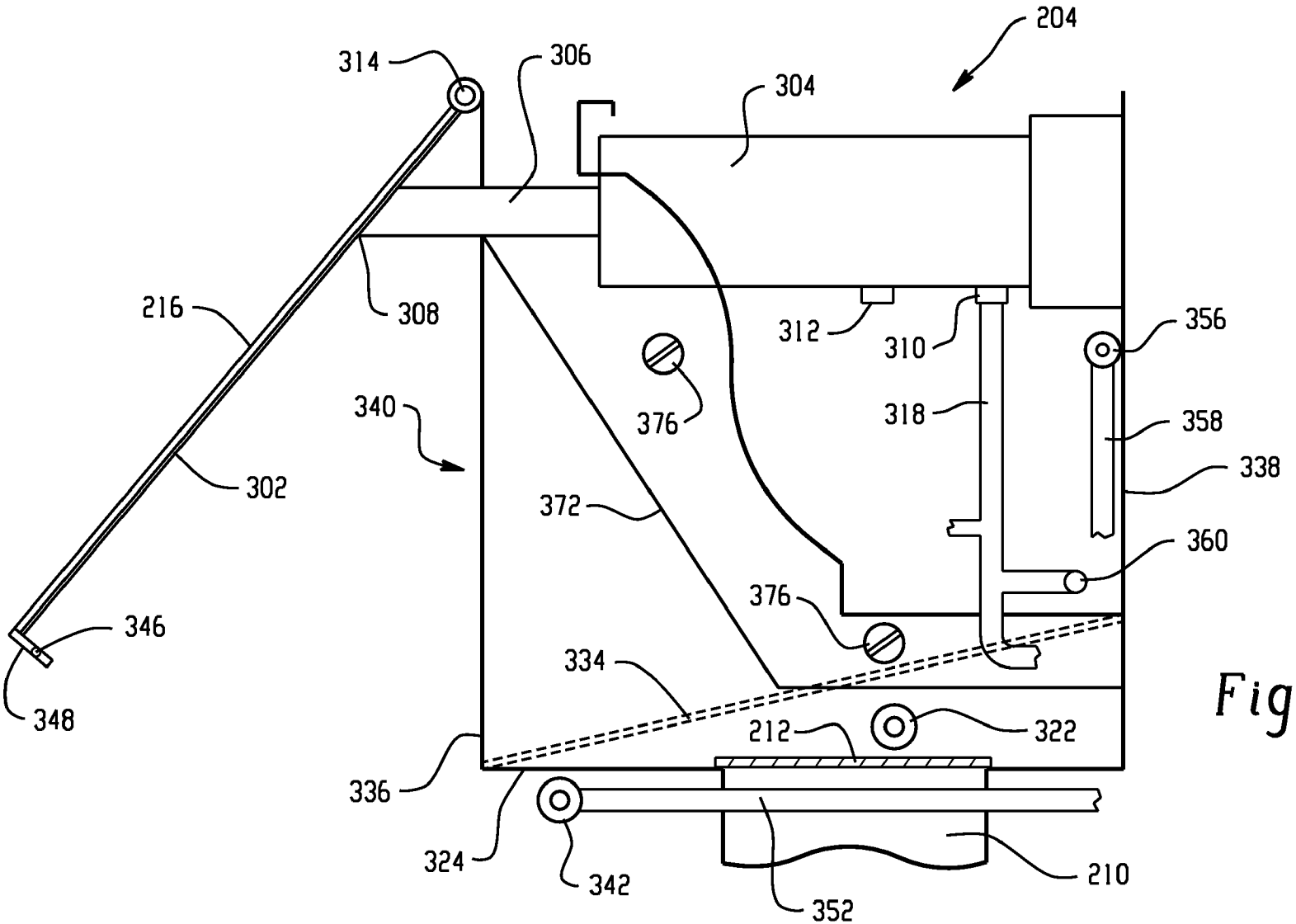

Initially referring to FIGS. 3 and 4, a front view of a gutter member 200 is illustrated. The gutter member 200 includes the exit port door 216, which is shown in an open position. A gasket 302 or the like is use in connection with the exit port door 216 to facilitate establishing a seal when the exit port door 216 is closed. An exit port door actuator 304, which may be hydraulically activated, of the exit port door opener 216 drives a piston 306 that engages and moves the exit port door 216. The piston 306 may be affixed to or releasably engages a holder 308. The exit port door 216 pivots about an exit port door hinge 314 when moving between a closed position and an open position.

Actuating fluid is provided to the actuator 304 through an inlet port 310 via a fluid transportation line 318 of the fluid dispensing device 224, and is released from the actuator 304 through an outlet port 312. The actuating fluid causes the piston 306 to advance towards the exit poor door 216. As the piston 306 retracts back into the actuator 304, actuating fluid in the actuator 304 is expelled through the outlet port 312. In one instance, the outlet port 312 is positioned so that the expelled fluid back-washes the reservoir 206. It is to be appreciated that the illustrated location of the inlet port 310, the outlet port 312, and/or the fluid transportation line 318 can be alternatively positioned and located with respect to the gutter member 200.

The outlet door 212 pivots about an outlet door hinge 320 between a closed position in which the outlet door 212 covers the outlet 210 and an open position in which the outlet door 212 pivots away form the outlet 210. An outlet door actuator 322, which may be hydraulically activated, is affixed to a floor 324 of the gutter member 200 and is affixed to the outlet door 212, and drives a piston 326 that opens and closes the outlet door 212. Actuating fluid is provided to the actuator 322 through an inlet port 328 via a fluid transportation line 330 of the fluid dispensing device 224, and is released from the actuator 322 through an outlet port 332. In one instance, the outlet port 332 is positioned so that the expelled fluid back-washes the reservoir 206. Likewise, the illustrated location of the inlet port 328, the outlet port 332, and/or the fluid transportation line 330 can be alternatively positioned and located with respect to the gutter member 200.

A screen 334 extends from a front 336 of the floor 324 of the gutter member 200 to a back 338 of the gutter member 200. As shown, the screen 334 may slope in a downward direction from the back 338 to the front 336. In addition, the screen 334 may be positioned between the exit port 210 (and exit port door 216) and an opening 340 defined by the exit port door 216.

An exit door latch actuator 342, which may be hydraulically actuated, is located on an outer side of the bottom of the gutter member 200. The actuator 334 moves a piston 344 in and out of a recess 346 in a protrusion 348 affixed to the exit port door 216. Actuating fluid is provided to the actuator 342 through an inlet port 350 via a fluid transportation line 352 of the fluid dispensing device 224, and is released from the actuator 342 through an outlet port 354.

Figure 5:
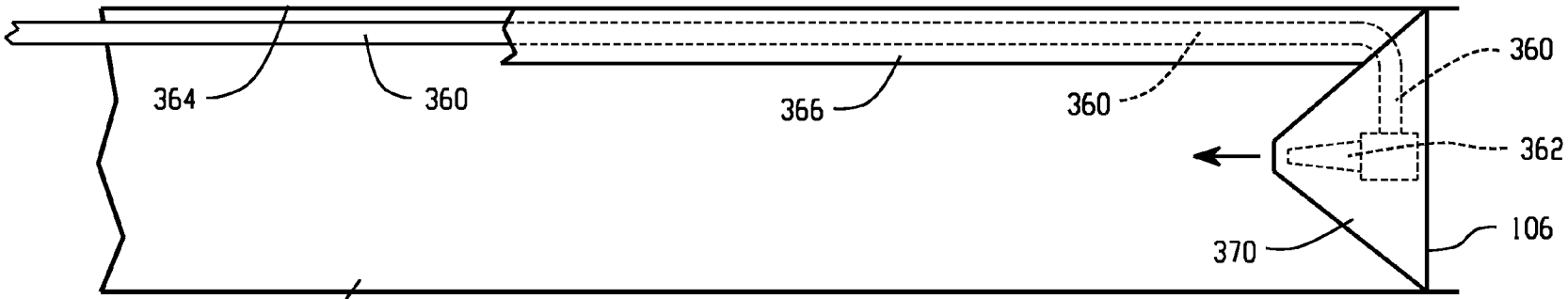
Figure 7:
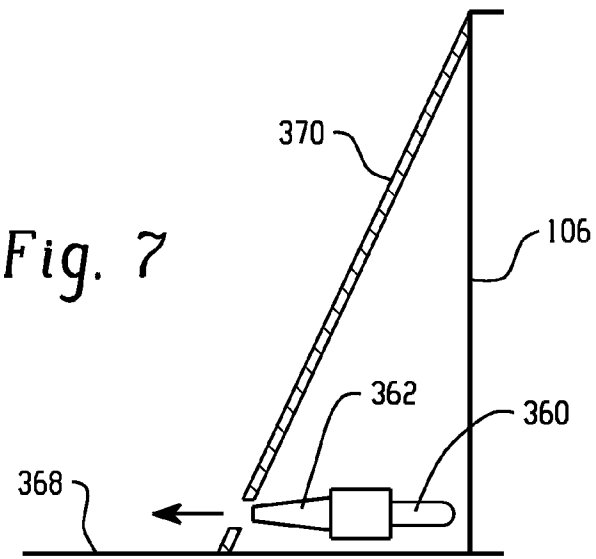
Figure 6:
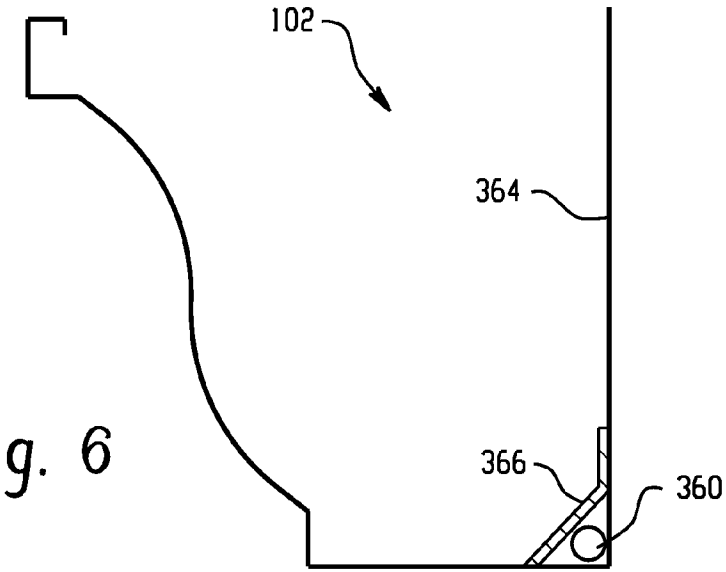

Nozzles 356 attached to the dispensing devices 224 receive fluid from fluid transporting lines 358. The nozzles 356 are located in the gutter member 200 and face outward towards the gutter troughs 102. Fluid transporting lines 360 supply fluid to nozzles 362 located at the end cap 106, as shown in FIG. 5-7. FIG. 5 shows a top-down view of the gutter trough 102 and the fluid transporting line 358 therein running along an inner wall 364 of a gutter trough 102 and under a shield 366. FIG. 6 shows a cross-sectional view of the gutter trough 102, the fluid transporting line 360, and the shield 366. FIGS. 5 and 7 show that the fluid transporting line 360 feeds the nozzle 362. As shown in FIG. 6, the nozzle 362 may be positioned near a floor 368 of the gutter trough 102. FIGS. 5 and 7 also show a nozzle shield 370.

Returning to FIGS. 3 and 4, end seals 372 are affixed to side walls 374 of the gutter member 200 via fasteners 376 such as screws, bolts, rivets, etc. As shown in FIG. 4, the seals 372 are shaped to conform to the perimeter of a gutter trough 102. As such, the seals 372 support the ends 106 of a gutter trough 102. The illustrated shape of the seals 372 is provided for explanatory purposes, and could be shaped otherwise to conform to other gutter troughs 102.

Figure 8:
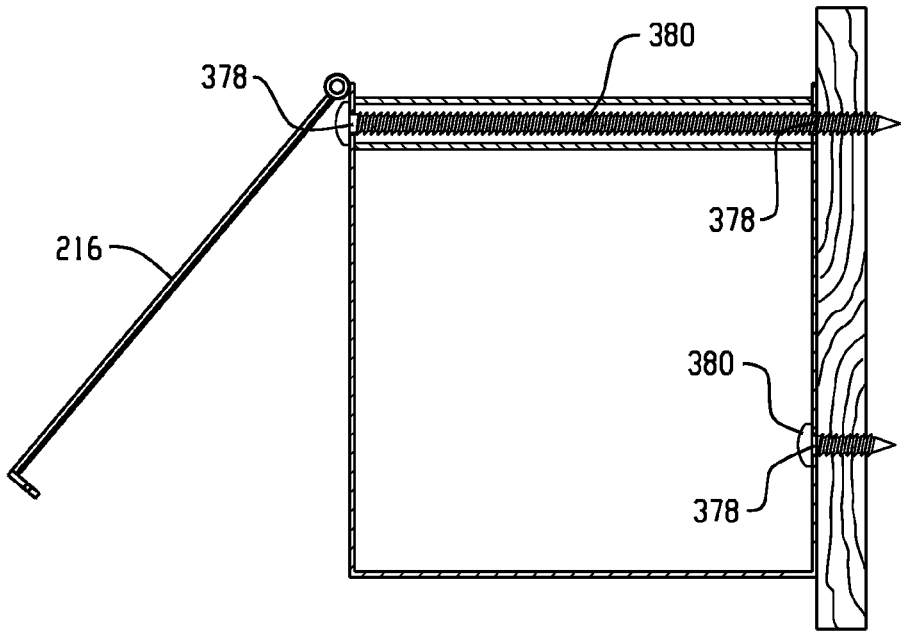

As shown in FIGS. 3 and 8, the gutter member 200 is coupled to a fascia board through mounting holes 378. Fasteners 380 such as nails, screws, etc. extend through the mounting holes 378 and into the fascia board.

Figure 1:
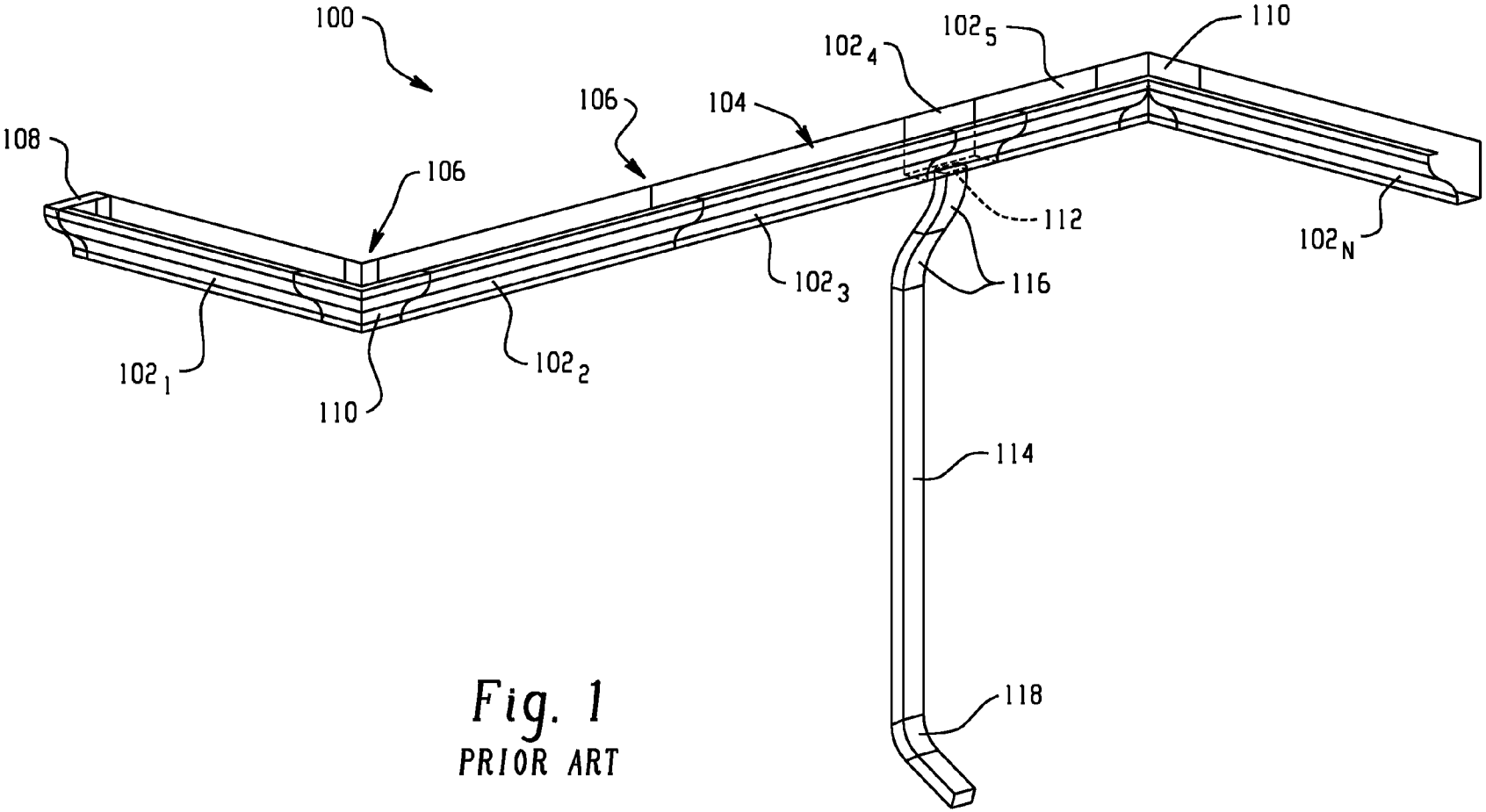
Fig. 1 PRIOR ART
FIG. 1 illustrates a section of a prior art rain gutter system.
Figure 9:
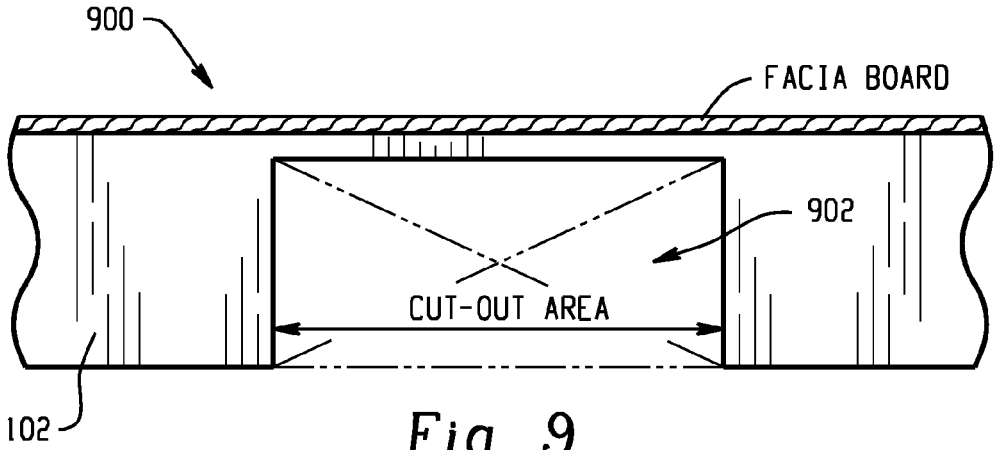
Figure 10:
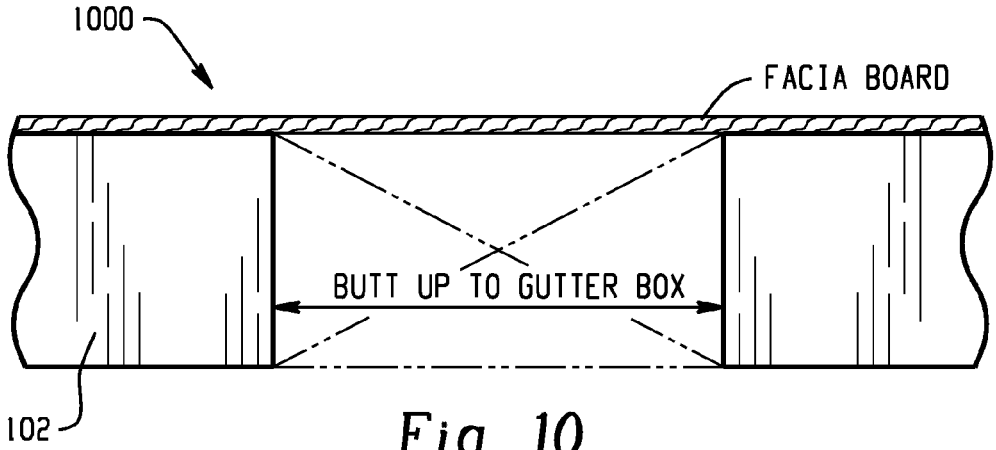

FIGS. 9 and 10 illustrate non-limiting techniques for installing the gutter member 200 respectively with an existing gutter system 900 and a new gutter system 1000. With respect to FIG. 9, a sub-region 902 of the existing gutter system 900 is removed. A pattern or the like may be provided to facilitate defining the sub-region 902. With respect to FIG. 10, the gutter troughs 102 can be accordingly cut based on the gutter member 200, and the trough ends 106 (FIG. 1) can be coupled to the gutter member 200 as described above, for example, via the seals 372, or otherwise.

Figure 11:
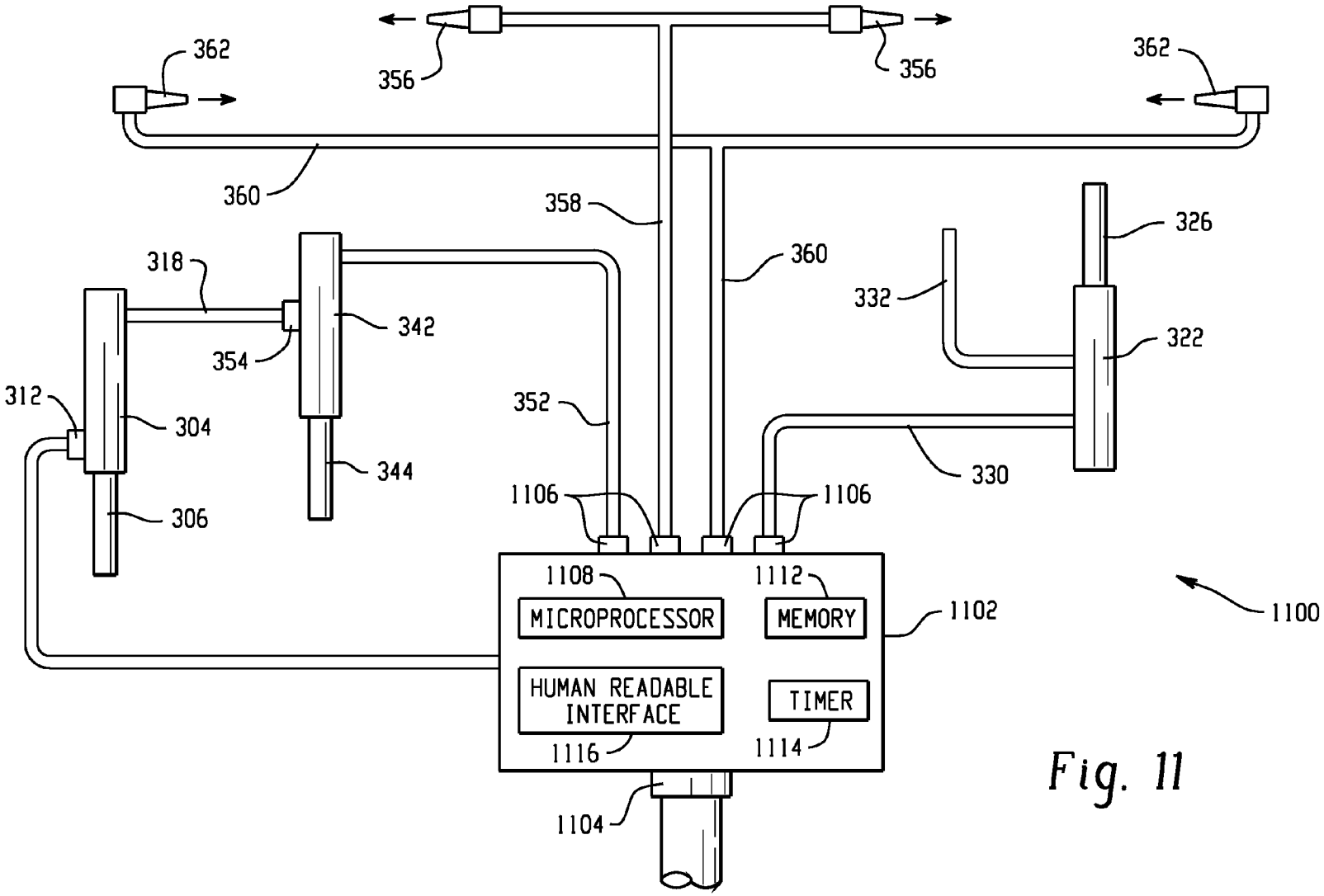
FIG. 11 illustrates a system that controls the gutter member.

As illustrated in connection with FIG. 11, the gutter member 200 can be used in conjunction with a control system 1100. The control system 1100 includes a control module 1102. The control module 1102 may receive operating power via a power mains line like an alternating current (AC) line associated with the building, one or more batteries, a solar cell, and/or one or more other power supplies. The control module 1102 also includes a receiving port 1104 for receiving fluid used to feed the fluid transporting lines 330, 360, 358, 352, and 318, and one or more exits ports 1106 for conveying the fluid to the transporting lines 330, 360, 358, 352, and 318. The control module 1102 may include a microprocessor 1108, memory 1112, a timer 1114, a human readable interface 1116, as well as various other components (not visible).

The microprocessor 1108 can be used to execute program code stored in the memory 1112 to distribute the received fluid amongst the exit ports 1106. The timer 1114 may be used to selectively convey the fluid to different exit ports 1106 based on an executing program. The control system 1100, the receiving port 1104, and/or the exits ports 1106 can be variously located. For example, all of them can be located near ground level. In another example, all of them can be located near the gutter member 200. In yet another example, some of these can be located near ground level while others can be located near the gutter member 200. As such, multiple lines may run from the ground to the gutter member 200 or a single line may be run from the ground to the gutter member 200 where the single line suitably branches off to feed the other lines.

Figure 12:
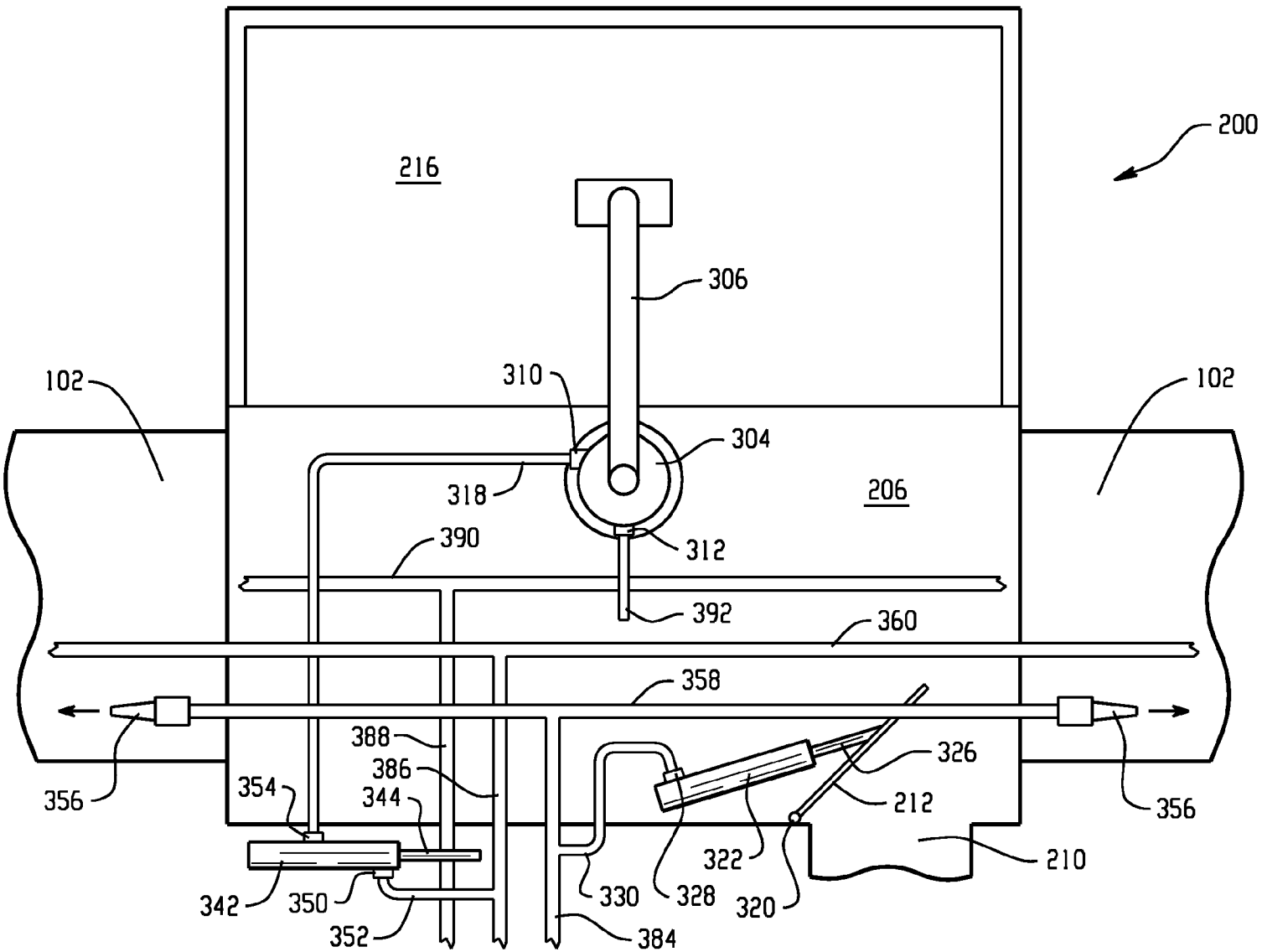
FIGS. 12-15 illustrate other non-limiting examples of the gutter member.

FIG. 12 illustrate another non-limiting implementation of fluid transporting lines and nozzles. It is to be appreciated that various components discussed above such as the filter 344, the mounting holes 378 (FIG. 3), etc. are not shown in FIG. 12, but are as described herein. In this example, fluid supply lines 384, 386, and 388 supply fluid to the gutter member 200. As shown, the fluid supply line 384 supplies fluid to the fluid transportation line 330, which feeds the outlet door actuator 322 via the inlet port 328. Note that in this example, the inlet port 328 also serves as the outlet port of the actuator 322. As such, fluid entering the actuator 322 through the inlet port 328 advances the piston 326, and when the piston 326 retracts back into the actuator 322, the fluid in the actuator 322 exits through the inlet port 328. The fluid supply line 384 also supplies fluid to the fluid transportation line 358, which feeds the nozzles 356 as described herein.

The fluid supply line 386 supplies fluid to the fluid transportation line 352, which feeds the exit port door opener actuator 342 via the inlet port 350. Unlike the example in FIG. 11, the outlet port 354 supplies fluid to the exit port door actuator 304. As shown, this is achieved by using the outlet port 354 to feed the fluid transportation line 318, which feeds the exit port door actuator 304 via the inlet port 310. In this example, the fluid supply line 386 also supplies fluid to the transportation line 360, which supplies fluid to the nozzles 362 (not visible in FIG. 12). The fluid supply line 388 supplies fluid to a fluid transportation line 390, which is used to wash, such as back wash, the reservoir 206. The outlet port 312, as above, is also used to provide a wash, such as back wash, for the reservoir 206. However, unlike above, a fluid transportation line 392 is used to direct the fluid leaving the actuator 304.

It is to be appreciated that the same fluid may be supplied through each of the fluid supply lines 384, 386, and 388. Alternatively, one or more of the fluid supply lines 384, 386, and 388 may be supplied with different fluid. Where two or more of the fluid supply lines 384, 386, and 388 are supplied with the same fluid, it is to be appreciated that the fluids may come from the fluid source or a different fluid source. Moreover, the point at which the source branches off into the different one of the fluid supply lines 384, 386, and 388 may be located near ground level or near the gutter member 200.

Figure 13:
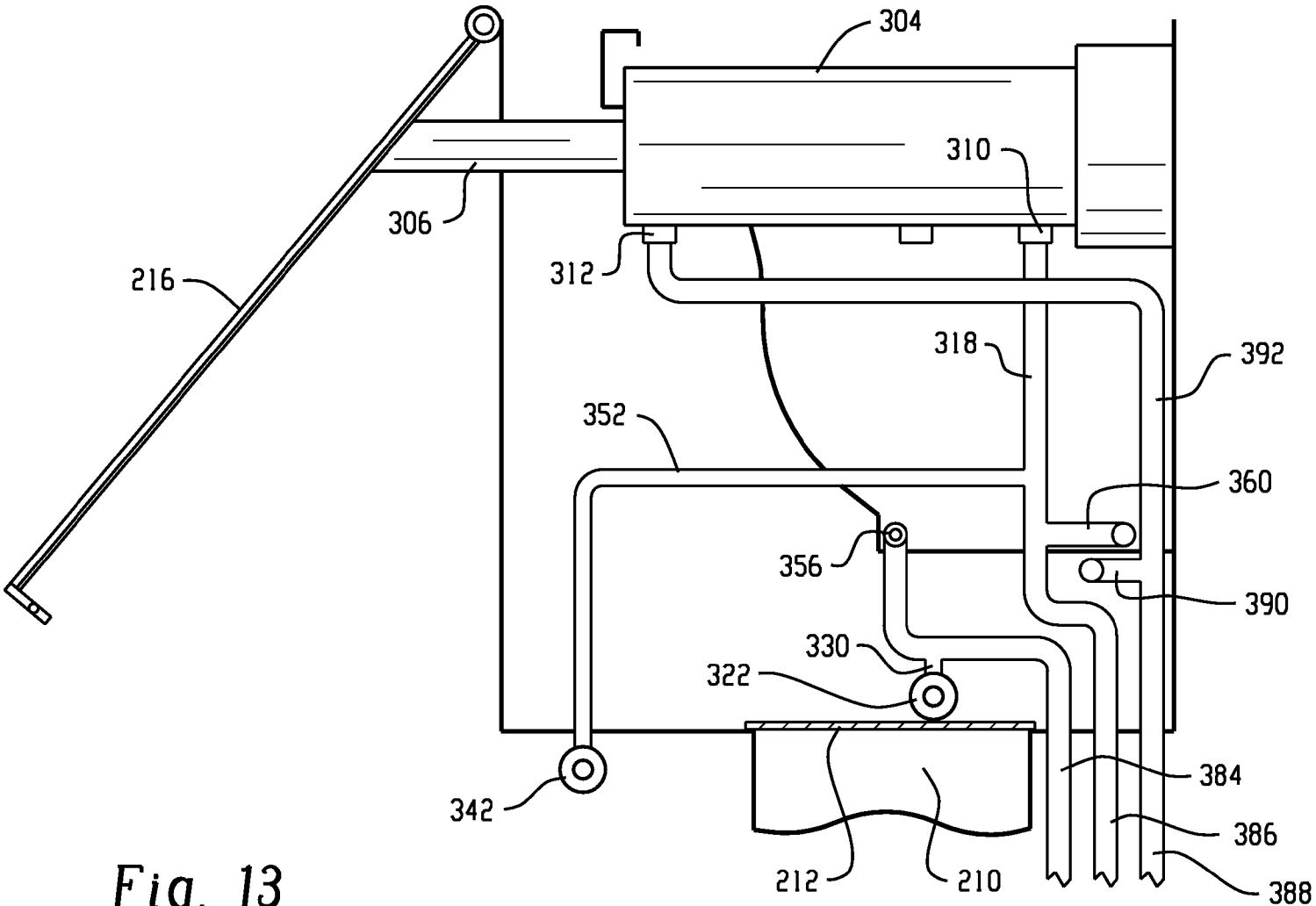

FIG. 13 illustrate another non-limiting implementation of fluid transporting lines and nozzles. As shown, the fluid supply line 384 supplies fluid to the outlet door actuator 322 and the nozzles 356 as described above. The fluid supply line 386 supplies fluid to the exit port door opener actuator 342 as described above. However, in this example, the fluid supply line 386 also supplies fluid to the exit door actuator 304 via the fluid transportation line 318 and the end nozzles (not visible in FIG. 13) via the fluid transportation line 360. The fluid supply line 388 supplies fluid to a fluid transportation line 390 as described above. However, in this example the outlet port 312 of the exit door actuator 304 also supplies fluid to the fluid transportation line 390.

Figure 14:
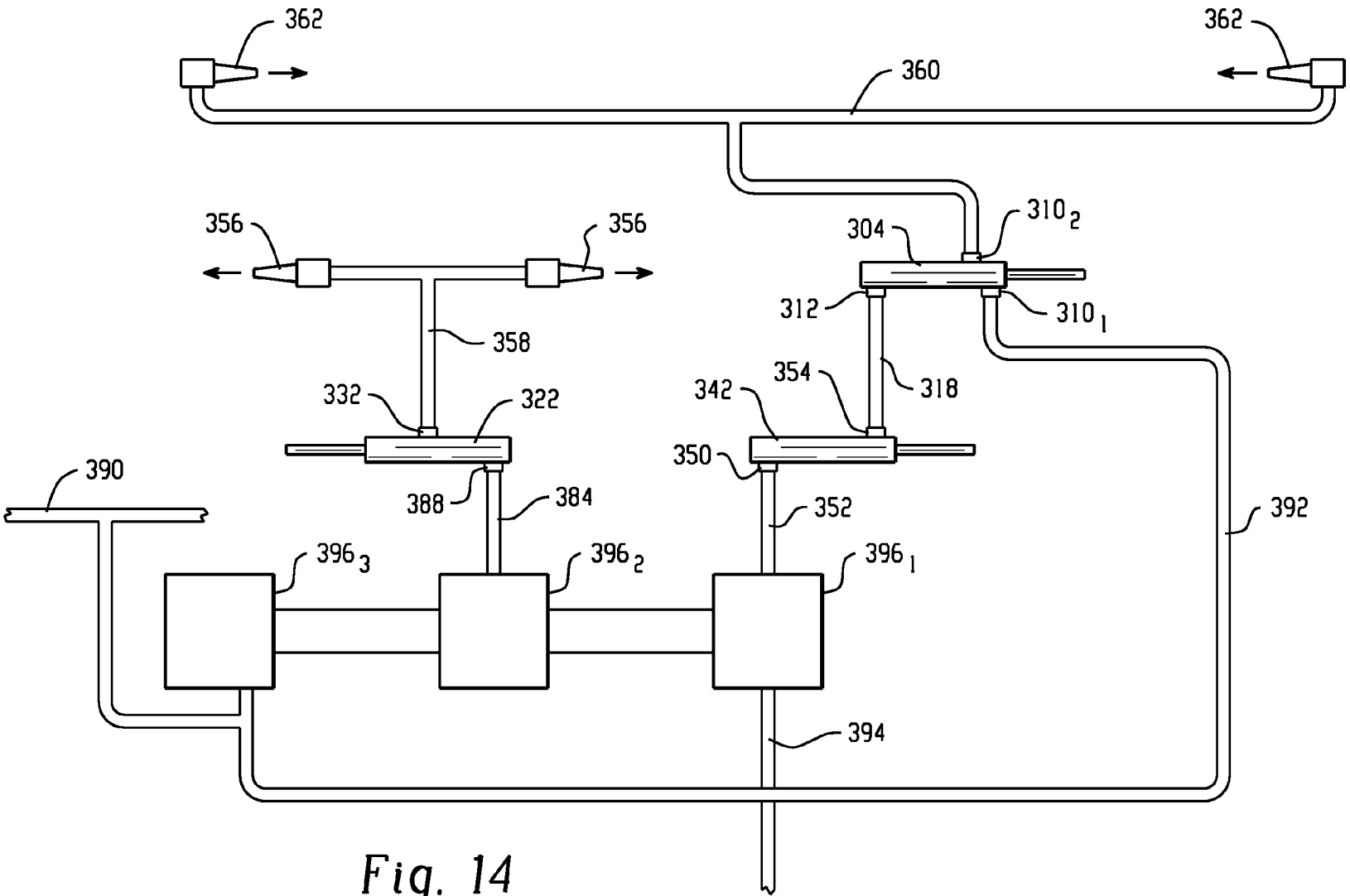

FIG. 14 illustrate another non-limiting implementation of fluid transporting lines and nozzles. In this example, a single supply line 394 supplies fluid to multiple dispersing units 396, namely $\mathbf{396}_1$, $\mathbf{396}_2$, and $\mathbf{396}_3$, which may include solenoids or the like. Three dispersing units 396 are shown. However, in other embodiments more or less dispersing units 396 may be employed. The dispersing unit $\mathbf{396}_1$ supplies fluid to the fluid transportation line 352, which feeds the exit port door opener actuator 342. The exit port door opener actuator 342 feeds the exit port door actuator 304, which feeds both the fluid transportation line 360 to the nozzles 362 in the end caps 106 (FIG. 1) and the fluid transportation line 392 to the back wash fluid transportation line 390.

The dispersing unit 396, also supplies fluid to the dispersing unit $\mathbf{396}_2$. The dispersing unit $\mathbf{396}_2$ supplies fluid to the fluid transportation line 384, which feeds the outlet door actuator 322. The outlet door actuator 322 feeds the fluid transportation line 358, which feeds the nozzles 356. The dispersing unit $\mathbf{396}_2$ also supplies fluid to the dispersing unit $\mathbf{396}_3$. The dispersing unit $\mathbf{396}_3$ supplies fluid to the fluid transportation line 392, which feeds the back wash fluid transportation line 390. It is to be appreciated that the control module 1102 (FIG. 11) or another device may control the dispersing units 396.

It is to be appreciated that the above examples are not exclusive and are provided for explanatory purposes. Various other implementations are also contemplated herein.

Figure 15:
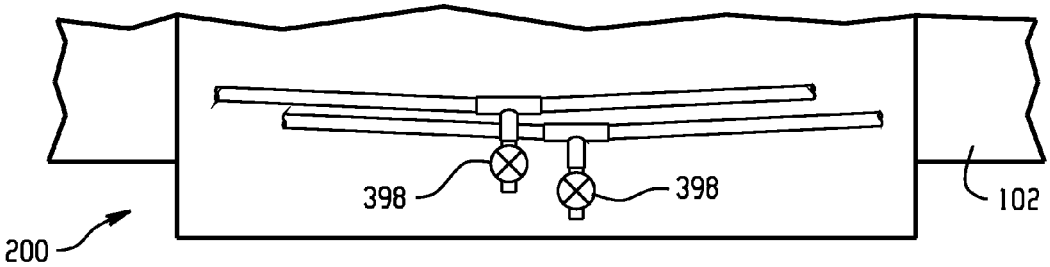

FIG. 15 shows that any or all of the fluid transporting lines described herein may be sloped. In this example, valves 398 or the like are used in conjunction with one or more of the fluid transporting lines. The valves 398 may be manually controlled via a user and/or automatically controlled via the control module 1102 and/or other device. The valves 398 can be opened to let fluid drain from the fluid transporting lines or closed so that fluid cannot drain from the fluid transporting lines. In the illustrated example, the valves 398 are located at or near a low point in the slop so that fluid automatically flows thereto due to gravity. It is to be appreciated that air or the like can be blown through the transportation lines to facilitate moving any fluid or other matter towards the valves 398.

Figure 16A:
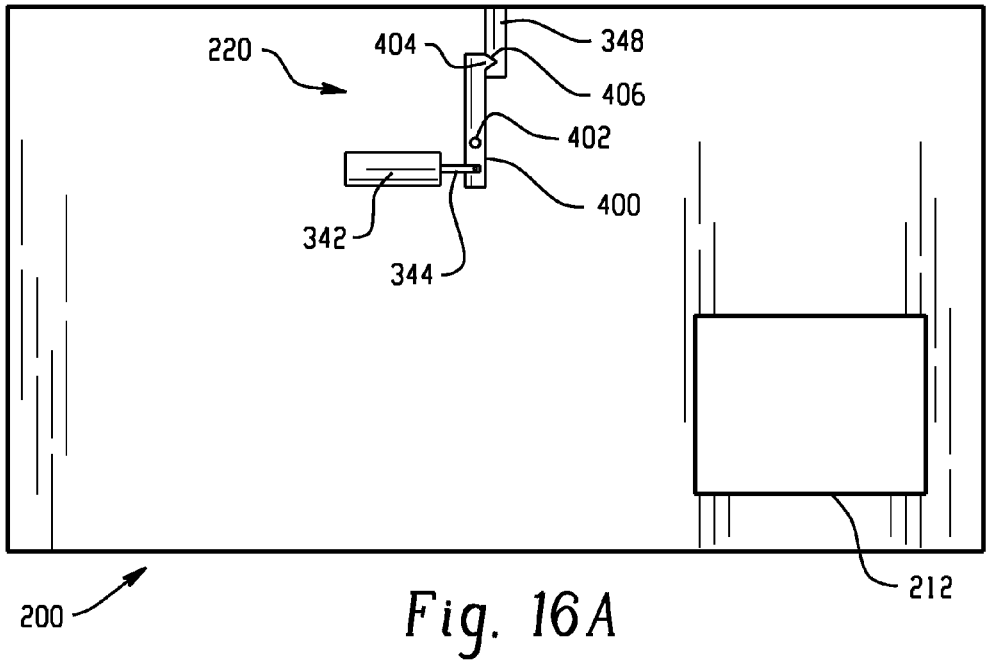
FIGS. 16A and 16B illustrate an example of an exit port door latch.
Figure 16B:
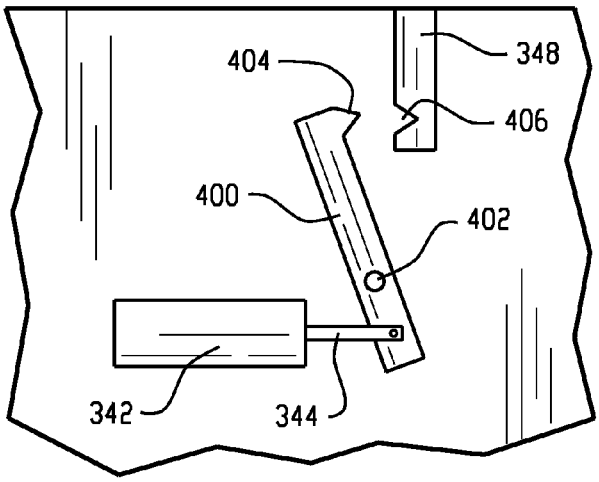

FIGS. 16A and 16B illustrate an alternative exit port latch 220. As shown, the latch 220 may include a rotating member 400 that rotates about a rotation axis 402, which may be defined in connection with a fastener such a pin, a spring loaded pin, a rivet, coil under compression, and the like. The rotating member 400 includes a protrusion 404. Although the protrusion 404 is shown triangularly shaped, it may be various other shapes in other instances. The protrusion 348, which is coupled to the exit port door 216 as described above, includes a recess 406 that is complementary to the protrusion 404 in that the protrusion 404 may engage the recess 406. However, the shapes of the protrusion 404 and the recess 406 do not have to be identical.

In operation, when the pin 344 is recessed in the actuator 342, the member 404 rotates in a first direction and the protrusion 404 engages the recess 406, which locks the exit port door 216. This state is shown in FIG. 16A. When the pin or piston 344 is advance, for example, when fluid is supplied to the actuator 342, the member 404 rotates in a second opposite direction, and the protrusion 404 disengages the recess 406, which unlocks the exit port door 216. This state is shown in FIG. 16B.

Figure 17:
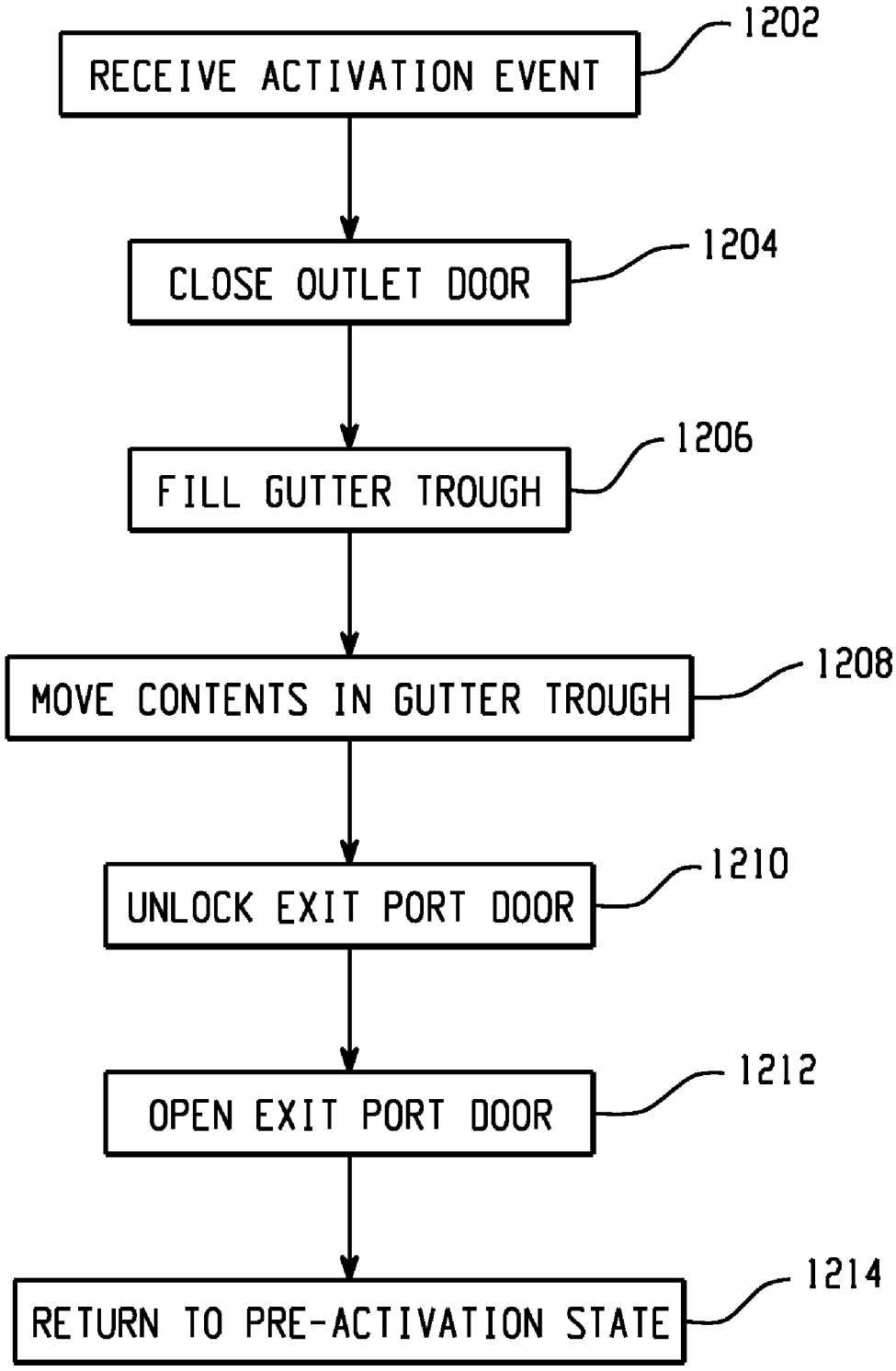
FIG. 17 illustrates a method of using the gutter member.

FIG. 17 illustrates a method of using the gutter member 200. In a pre-activation state, water and non-water matter may enter the gutter member 200, wherein the water passes through the filter 208 and leaves the gutter member reservoir 206 through the outlet 210. The filter 208 reduces the amount of non-water matter that may enter the outlet 210, and collect the non-water matter.

At 1202, a signal indicative of activation event is received by the control module 1102. In one instance, the signal is manually provided by a user. For example, a user may manually press an "on" button on the control module 1102. In another instance, the signal may be generated based upon an executing program. For example, the control module 1102 may be executing a program in which the signal is generated on the first Saturday of each month. In another instance, the signal is generated based upon the detection of an event, such as rain, the weight of the matter in the gutter member reservoir 206, and/or other detected event.

At 1204, the outlet door 212 is closed. This can be achieved by providing the fluid to the outlet hole actuator 322 via the fluid transportation line 330. As the fluid enters the inlet port 328, the fluid retracts the piston 326, which closes the outlet door 212. At 1206, the fluid is used to fill the gutter trough 102. This can be achieved by providing the fluid to the nozzles 356 located within the gutter member 200 via the fluid transportation lines 358. The nozzles 356 can be configured to dispense, jet, spray, etc. the fluid based on a length, volume, and/or characteristic of the gutter troughs 102. Alternatively, the executing program may take into account the length, volume, and/or characteristic of the gutter troughs 102 to accommodate different gutter troughs 102.

At 1208, the fluid is used to move the contents in the gutter trough 102, including the water and non-water matter, towards the gutter member 200. This can be achieved by providing the fluid to the nozzles 362 located at the end caps 106 via the fluid transportation line 360 and ceasing to provide the fluid to the nozzles 356. Likewise, the nozzles 362 may dispense, jet, spray, etc. the fluid. In addition, the nozzles 362 can be configured based on the length, volume and/or other characteristic of the gutter troughs 102 or the executing program may take into account such characteristic. The contents are moved such that the water and non-water matter enter the gutter member reservoir 206, where the content is held with any matter that may have entered the reservoir 206 and/or remained in the reservoir 206 after the previous flushing.

At 1210, the exit port door 216 is unlocked. This can be achieved by providing the fluid to the exit port door latch actuator 342 via the fluid transportation line 352. As the fluid enters the inlet 350, the fluid retracts the piston 344 from the recess 346, which unlocks the exit port door 216. At 1212, the exit port door 216 is opened. This can be achieved by providing the fluid to the exit port door actuator 304 via the fluid transportation line 318. As the fluid enters the inlet port 310, the fluid advances the piston 306, which opens the exit port door 216. As the door opens, the contents of the gutter member reservoir 206 empties via the exit port 216. This includes both water and non-water matter in the reservoir 206.

At 1214, the gutter member 200 is returned to a pre-activation state. This may include ceasing to supply the fluid to the nozzles 362 and the actuator 304. As a result, the exit door piston 306 retracts, and the exit port door 212 returns to a closed position. Once the exit port door 212 closes, which may be detected via an inductive coupling or other closed-loop technique, the control module 1102 ceases to supply the fluid to the exit port door lock actuator 342. As a result, the piston 344 advances back into the recess 346.

In the pre-activation state, water and non-water matter again enter the gutter member 200, wherein the water passes through the filter 208 and leaves the gutter member reservoir 206 through the outlet 210. The gutter member 200 can be activated again as described in connection with reference numeral 1202.

Other applications include, but are not limited to, irrigation, septic, oil pipeline, gas pipeline, as well as other applications in which a it is desirable to channel fluid.

The foregoing description has been presented for purposes of illustration; it is not intended to be exhaustive or limiting. Modifications and/or variations may occur to others upon reading the description and intended to be included within the scope of the claimed subject matter or equivalents thereof.

We claim:

1. A gutter member, comprising:

at least one gutter trough receiving region configured to receive an open end of an elongate gutter trough that has two opposing ends;

an inlet operatively coupled to the at least one gutter trough receiving region, wherein the inlet is configured to receive matter such as water and non-water matter from the gutter trough;

an outlet operatively coupled to a top of a downspout, wherein the outlet is configured to pass water to the downspout; and a reservoir configured to collect non-water matter, wherein the reservoir is located between the inlet and the outlet and is lower than the gutter trough relative to the earth, the reservoir including:

an exit port door configured to move between a first position in which a substantial amount of the non-water matter is retained in the reservoir and a second position in which the substantial amount of non-water matter is released from the reservoir.

2. The gutter member of claim 1, further including a filter configured to prevent non-water matter from entering the outlet.

3. The gutter member of claim 2, wherein the filter is disposed over the outlet.

4. The gutter member of claim 3, wherein the filter is disposed between the inlet and the reservoir and the outlet.

5. The gutter member of claim 1, further including an exit port door opener having:

a hydraulic actuator, including:

an inlet port;

a piston; and an outlet, wherein the inlet port is configured to selectively receive a fluid that advances the piston to engage and open the exit port door, and the outlet port is configured to selectively expel the fluid to retract the piston and close the exit port door.

6. The gutter member of claim 5, further including an exit pod latch that locks and unlocks the exit port door.

7. The gutter member of claim 6, further including a latch opener having a hydraulic actuator that opens and closes the exit port latch.

8. The gutter member of claim 5, further including an outlet door configured to transition between a first position in which the outlet door covers the hydraulic actuator outlet and a second position in which the hydraulic actuator outlet is exposed.

9. The gutter member of claim 8, further including an outlet door opener having a hydraulic actuator that opens and closes the outlet door.

10. The gutter member of claim 1, further including at least one nozzle disposed in the reservoir that sprays a fluid in an outward direction relative to the gutter member into a gutter trough.

11. The gutter member of claim 1, further including at least one nozzle located proximate at least one end cap of a gutter trough, wherein the nozzle sprays a fluid into the gutter trough in a direction towards the gutter member.

12. The gutter member of claim 11, further including a fluid transportation line that supplies the fluid to the nozzle, wherein the fluid transportation runs along the gutter trough to the nozzle and the fluid is supplied to the nozzle based on the length and volume of the gutter trough.

13. The gutter member of claim 1, further including a first nozzle disposed in the reservoir that sprays a first fluid in an outward direction relative to the gutter member into a gutter trough, and a second nozzle located proximate at least one end cap of a gutter trough, wherein the second nozzle sprays the second fluid into the gutter trough in a direction towards the gutter member, wherein the second nozzle is activated to spray the second fluid after the first nozzle ceases to spray the first fluid.

14. The gutter member of claim 1, further including a control system having a processor, wherein the control system controls the position of the exit port door based on a program executed by the processor.

15. The gutter member of claim 1, wherein the gutter member forms part of an existing rain gutter system.

16. The gutter member of claim 1, wherein the gutter member is installed with a new rain gutter system.

17. A gutter member, comprising:

an inlet operatively coupled to gutter trough, wherein the inlet is configured to receive matter such as water and non-water matter from the gutter trough;

an outlet operatively coupled to a top of a downspout, wherein the outlet is configured to pass water to the downspout;

a reservoir configured to collect non-water matter, wherein the reservoir is located between the inlet and the outlet and is lower than the gutter trough relative to the earth, the reservoir including: an exit port door configured to move between a first position in which a substantial amount of the non-water matter is retained in the reservoir and a second position in which the substantial amount of non-water matter is released from the reservoir; and a control system having a processor, wherein the control system controls the position of the exit port door based on a program executed by the processor.

18. The gutter member of claim 17, further comprising:

an exit port door opener having:

a hydraulic actuator, including:

an inlet port;

a piston; and an outlet, wherein the inlet port is configured to selectively receive a fluid that advances the piston to engage and open the exit port door, and the outlet port is configured to selectively expel the fluid to retract the piston and close the exit port door.

19. The gutter member of claim 17, further including at least one nozzle disposed in the reservoir that sprays a fluid in an outward direction relative to the gutter member into a gutter trough.

20. A gutter member, comprising:

an inlet operatively coupled to gutter trough, wherein the inlet is configured to receive matter such as water and non-water matter from the gutter trough;

an outlet operatively coupled to a top of a downspout, wherein the outlet is configured to pass water to the downspout;

a reservoir configured to collect non-water matter, wherein the reservoir is located between the inlet and the outlet and is lower than the gutter trough relative to the earth, the reservoir including: an exit port door configured to move between a first position in which a substantial amount of the non-water matter is retained in the reservoir and a second position in which the substantial amount of non-water matter is released from the reservoir; and at least one nozzle disposed in the reservoir that sprays a fluid in an outward direction relative to the gutter member into a gutter trough.

* * * * *